US010434556B2

(12) United States Patent
Nakajima et al.

(10) Patent No.: US 10,434,556 B2
(45) Date of Patent: Oct. 8, 2019

(54) HOT-PRESSED MEMBER AND METHOD OF MANUFACTURING THE SAME

(71) Applicant: JFE Steel Corporation, Tokyo (JP)

(72) Inventors: Seiji Nakajima, Chiba (JP); Minako Morimoto, Kawasaki (JP); Satoru Ando, Chiba (JP)

(73) Assignee: JFE Steel Corporation, Tokyo (JP)

( * ) Notice: Subject to any disclaimer, the term of this patent is extended or adjusted under 35 U.S.C. 154(b) by 265 days.

(21) Appl. No.: 14/899,319

(22) PCT Filed: May 13, 2014

(86) PCT No.: PCT/JP2014/002504
§ 371 (c)(1),
(2) Date: Dec. 17, 2015

(87) PCT Pub. No.: WO2014/203445
PCT Pub. Date: Dec. 24, 2014

(65) Prior Publication Data

US 2016/0158822 A1 Jun. 9, 2016

(30) Foreign Application Priority Data

Jun. 19, 2013 (JP) ..... 2013-128201

(51) Int. Cl.
*B21D 22/00* (2006.01)
*B21D 22/02* (2006.01)
(Continued)

(52) U.S. Cl.
CPC ..... *B21D 22/022* (2013.01); *C22C 18/00* (2013.01); *C22C 38/001* (2013.01);
(Continued)

(58) Field of Classification Search
None
See application file for complete search history.

(56) References Cited

U.S. PATENT DOCUMENTS

2001/0042393 A1 11/2001 Kefferstein et al.
2012/0164472 A1 6/2012 Kuhn et al.
2012/0321903 A1* 12/2012 Nakamaru ..... B32B 15/013 428/450

FOREIGN PATENT DOCUMENTS

EP 2 644 751 10/2013
GB 1490535 A 11/1977
(Continued)

OTHER PUBLICATIONS

Concise Statement of Relevance of Office Action in English based on an Office Action dated Feb. 16, 2016 of corresponding Japanese Application No. 2014-538017.
(Continued)

*Primary Examiner* — Daniel J. Schleis
(74) *Attorney, Agent, or Firm* — DLA Piper LLP (US)

(57) ABSTRACT

Provided is a hot-pressed member excellent in terms of paint adhesiveness and a method of manufacturing the hot-pressed member. A hot-pressed member has a coating layer containing Zn and Ni on the surface of a steel sheet of which the member is formed, an oxide film containing Zn on the coating layer, and a void formation rate is 80% or less for voids formed between the coating layer and the oxide film.

4 Claims, 1 Drawing Sheet

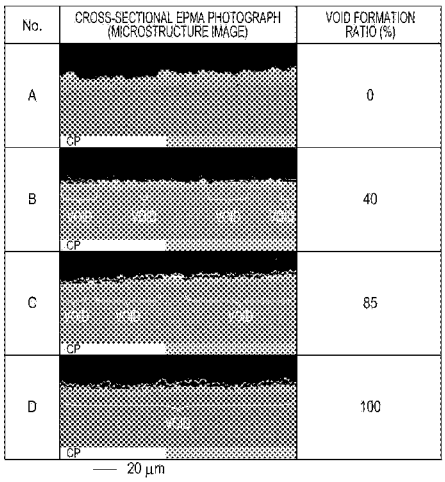

(51) Int. Cl.

| | |
|---|---|
| ***C22C 18/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C22C 38/28*** | (2006.01) |
| ***C22C 38/32*** | (2006.01) |
| ***C22C 38/60*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/18* (2013.01); *C22C 38/28* (2013.01); *C22C 38/32* (2013.01); *C22C 38/60* (2013.01)

(56) References Cited

FOREIGN PATENT DOCUMENTS

| | | | |
|---|---|---|---|
| JP | 3663145 | B2 | 6/2005 |
| JP | 2007-63578 | A | 3/2007 |
| JP | 4039548 | B2 | 1/2008 |
| JP | 2011-246801 | A | 12/2011 |
| JP | 2012-001816 | A | 1/2012 |
| JP | 2012-197505 | A | 10/2012 |
| WO | WO2011052797 | * | 5/2011 |
| WO | 2012/070482 | | 5/2012 |

OTHER PUBLICATIONS

Supplementary European Search Report dated Apr. 1, 2016, of corresponding European Application No. 14814538.6.

Korean Office Action dated Jul. 26, 2017, of corresponding Korean Application No. 10-2016-7001486, along with a Concise Statement of Relevance of Office Action in English.

Korean Office Action dated Nov. 10, 2017, of corresponding Korean Application No. 10-2016-7001486, along with a Concise Statement of Relevance of Office Action in English.

Chinese Office Action dated Apr. 4, 2018, of corresponding Chinese Application No. 201480034273.6, along with a Concise Statement of Relevance of Office Action in English.

European Office Action dated Jul. 18, 2018, of corresponding European Application No. 14 814 538.6.

Korean Office Action dated May 21, 2019, of counterpart Korean Application No. 10-2016-7001486, along with a Concise Statement of Relevance of Office Action in English.

Korean Grant of Patent dated Aug. 2, 2019, of counterpart Korean Application No. 10-2016-7001486, along with an English translation.

* cited by examiner

| No. | CROSS-SECTIONAL EPMA PHOTOGRAPH (MICROSTRUCTURE IMAGE) | VOID FORMATION RATIO (%) |
|---|---|---|
| A | CP | 0 |
| B | VOID VOID VOID VOID CP | 40 |
| C | VOID VOID VOID CP | 85 |
| D | VOID CP | 100 |

20 μm

HOT-PRESSED MEMBER AND METHOD OF MANUFACTURING THE SAME

TECHNICAL FIELD

This disclosure relates to a hot-pressed member that can be used for underbody members, body structure members and the like of automobiles and to a method of manufacturing the hot-pressed member.

BACKGROUND

To date, many underbody members, body structure members and the like of automobiles have been manufactured by performing press working on steel sheets having a specified strength. Nowadays, since there is a strong requirement to reduce the weight of an automobile body from the viewpoint of conservation of the global environment, efforts are being made to reduce the thickness of steel sheets used for automobile bodies by increasing the strength of the steel sheets. However, since an increase in the strength of steel sheets is accompanied by a decrease in press workability, there is an increase in the number of instances where it is difficult to form steel sheets into desired shapes for the members.

Therefore, UK Patent Publication No. GB 1490535 proposes a working technique called hot pressing which makes it possible to realize an increase in workability and an increase in strength at the same time by performing working and rapid cooling at the same time on a heated steel sheet using a mold composed of a die and a punch. However, in that hot pressing, since a steel sheet is heated at a high temperature of about 950° C. before hot pressing is performed, scale (iron oxide) is generated on the surface of the steel sheet, and flaking of the scale occurs when hot pressing is performed, which results in a problem in that a mold is damaged or in that the surface of a member is damaged after hot pressing has been performed.

Also, scale which is retained on the surface of a member results in a poor surface aesthetic appearance and causes a decrease in paint adhesiveness. Therefore, scale present on the surface of a member is usually removed by performing processing such as pickling and shot blasting. However, since such processing makes the manufacturing process complex, there is a decrease in productivity.

Moreover, the underbody members, body structure members and the like of automobiles are also required to have good corrosion resistance. However, since a hot-pressed member manufactured using the process described above is not provided with an anti-corrosion film such as a coating layer, the member is very poor in terms of corrosion resistance.

Therefore, since a hot pressing technique is required with which formation of scale can be suppressed when heating is performed before hot pressing is performed and with which the corrosion resistance of a hot-pressed member after hot pressing has been performed can be increased, a steel sheet to be hot-pressed whose surface is coated with a film such as a coating layer and a method of hot pressing which uses the steel sheet have been proposed. For example, Japanese Patent No. 3663145 discloses a method of manufacturing a hot-pressed member excellent in terms of corrosion resistance whose surface is coated with a Zn—Fe-based compound or a Zn—Fe—Al-based compound by performing hot pressing on a steel sheet which is coated with Zn or a Zn-based alloy.

In addition, in particular, to increase the paint adhesiveness of a galvanized steel sheet to be hot-pressed, Japanese Unexamined Patent Application Publication No. 2007-63578 discloses a galvanized steel sheet to be hot-pressed which is coated with a silicone resin film having a silanol group, and it is also said that the galvanized steel sheet is excellent in terms of phosphatability, after-painting corrosion resistance, and zinc volatility resistance.

However, in a hot-pressed member manufactured using the method according to Japanese Patent No. 3663145, a galvanized steel sheet or a zinc-aluminum-coated steel sheet having a low melting point is used. Therefore, since zinc undergoes an intense oxidation reaction on the surface of the coating layer in heating processing before hot pressing, a hot-pressed member obtained as a final product has insufficient paint adhesiveness. In addition, when the steel sheet to be hot-pressed described in Japanese Unexamined Patent Application Publication No. 2007-63578 is used, although there is an increase in the adhesiveness between a resin film, with which the surface of a coating layer is covered, and paint, since the galvanizing layer undergoes an intense oxidation under some heating treatments before hot pressing is performed, it is difficult to reliably achieve satisfactory paint adhesiveness.

It could therefore be helpful to provide a hot-pressed member excellent in terms of paint adhesiveness and a method of manufacturing the hot-pressed member.

SUMMARY

We found that a defect in paint adhesiveness which occurs when a zinc-type-plated steel sheet is subjected to hot pressing is caused by formation of voids between the coating layer and a zinc oxide film formed on the surface of the coating layer, that it is effective to prevent formation of voids to use a coated steel sheet having a Zn—Ni-alloy coating layer, which has a high melting point, on its surface, and that the degree of formation of voids depends on coating weight before heating is performed, the peak temperature of the coated steel sheet, and a total heating time.

The hot-pressed member is characterized as having a coating layer containing Zn and Ni on a surface of a steel sheet of which the hot-pressed member is formed, and an oxide film containing Zn on the coating layer. A void formation rate is 80% or less, of which void is formed between the coating layer and the oxide film.

In addition, the method of manufacturing a hot-pressed member is characterized as a manufacturing method including heating a coated steel sheet having a coating layer on a surface of the steel sheet, which contains 10 mass % or more and 25 mass % or less of Ni and the balance being Zn and inevitable impurities and which has a coating weight per side of 10 g/m$^2$ or more and 90 g/m$^2$ or less, under heating conditions satisfying expressions (1) and (2) and then performing hot pressing on the heated steel sheet:

$$850 \leq T \leq 950 \quad (1)$$

$$0 < t \leq \{20-(T/50)+(W/10)\} \quad (2),$$

where T represents the peak temperature (° C.) of the coated steel sheet, t represents a total heating time (minutes) of the coated steel sheet from the start of the heating to the end of the heating, and W represents the coating weight per side (g/m$^2$).

It is thus possible to manufacture a hot-pressed member excellent in terms of paint adhesiveness. The hot-pressed members manufactured using the method can preferably be used as the underbody members and body structure members of automobiles.

BRIEF DESCRIPTION OF THE DRAWING

FIG. 1 is a diagram illustrating the microstructure images of typical hot-pressed members having various void formation rate obtained using an EPMA (Electron Probe Micro Analyzer).

DETAILED DESCRIPTION

1) Hot-pressed Member 1-1) Coating Layer

The hot-pressed member has a coating layer containing Zn and Ni on the surface of a steel sheet of which the member is composed. The hot-pressed member composed of a steel sheet having such a coating layer thereon is excellent in terms of paint adhesiveness. This is because it is possible to prevent formation of voids between the coating layer and a zinc oxide film formed on the surface of the coating layer.

1-2) Oxide Film

The member is characterized as having an oxide film containing Zn on the coating layer containing Zn and Ni and as having a void formation rate of 80% or less, of which void is formed between the coating layer and the oxide film.

A defect in paint adhesiveness which occurs when zinc-type-plated steel sheet is subjected to hot pressing is caused by formation of voids between the coating layer and a zinc oxide film formed on the surface of the coating layer. To prevent formation of voids, it is effective to first use a coated steel sheet having a Zn-alloy coating layer which has a high melting point. In the hot-pressed member, a coated steel sheet having a coating layer containing Zn and Ni is used. In addition, an oxide film containing Zn is formed on the surface of the coating layer due to heating performed before hot pressing is performed. Examples of chemical elements other than Zn contained in the oxide film include Mn, which is contained in the base steel sheet.

The void formation rate between the coating layer and the oxide film of the member is limited to 80% or less. When the void formation rate is more than 80%, since these voids act as flaking interfaces such that flaking of the paint applied to the member occurs, there is a decrease in paint adhesiveness. When the void formation rate is 80% or less, even if voids exist, since portions without voids function as holding portions to maintain adhesiveness, paint adhesiveness is satisfactory.

It is possible to determine a void formation rate by performing cross-sectional observation of a hot-pressed member. It is appropriate that a void formation rate is determined by observing a region in a cross section having a length of 100 μm or more using, for example, an optical microscope, an SEM (Scanning Electron Microscope), or an EPMA (Electron Probe Micro Analyzer). For example, a small sample of 10 mm×10 mm is cut out of a hot-pressed member and embedded in a resin. The cross section of the embedded small sample of the hot-pressed member is observed using an EPMA. A microstructure image in the field of view of an EPMA is obtained at a magnification of 500 times and, then, a void formation rate is defined as the digitized proportion of the length of the portions in which voids are formed to the total length of the coating layer. FIG. 1 illustrates the relationship between the results (microstructure images) of the observation using an EPMA (at a magnification of field of view, 500 times) performed on typical samples having various void formation rates and the void formation rates.

It is possible to control the proportion of voids formed between a coating layer and the oxide film described above, that is, the void formation rate by controlling the conditions of the heating described below which is performed before hot pressing is performed.

2) Method of Manufacturing a Hot-pressed Member 2-1) Coated Steel Sheet

In the method of manufacturing a hot-pressed member, a coated steel sheet having a coating layer on the surface of the steel sheet, which contains 10 mass % or more and 25 mass % or less of Ni and the balance being Zn and inevitable impurities and which has a coating weight per side of 10 $g/m^2$ or more and 90 $g/m^2$ or less is used.

The Ni content in the coating layer is 10 mass % or more and 25 mass % or less to form a phase structure composed of a γ phase having a melting point of 881° C. in the coating layer. Since a γ phase has a high melting point, formation of an oxide film containing Zn is prevented. Therefore, since it is also possible to decrease the void formation rate between the coating layer and the oxide film, it is possible to achieve satisfactory paint adhesiveness. The γ phase has a crystal structure of any one of $Ni_2Zn_{11}$, $NiZn_3$, and $Ni_5Zn_{21}$, and it is possible to identify the structure by using an X-ray diffraction method.

The coating weight of the coating layer per side of the coated steel sheet used is 10 $g/m^2$ or more and 90 $g/m^2$ or less. When the coating weight per side is less than 10 $g/m^2$, since voids tend to be formed, there is insufficient paint adhesiveness for a hot-pressed member. When the coating weight per side is more than 90 $g/m^2$, there is an increase in cost. Therefore, the coating weight per side is 10 $g/m^2$ or more and 90 $g/m^2$ or less. It is possible to determine the coating weight of the coating layer by using a wet analysis method. Specifically, for example, by dissolving the whole coating layer whose coating area has been determined in an aqueous solution which is prepared by adding 1 g/L of hexamethylenetetramine as an inhibitor to a 6 mass %-hydrochloric acid aqueous solution, it is appropriate that the coating weight of the coating layer be determined from a decrease in weight due to dissolution.

A base coating layer may be formed under the coating layer described above. A base coating layer does not have any influence on paint adhesiveness. Examples of a base coating layer include a coating layer containing 60 mass % or more of Ni and the balance being Zn an inevitable impurities and having a coating weight of 0.01 $g/m^2$ or more and 5 $g/m^2$ or less.

There is no particular limitation on what method is used to form such a coating layer, and a well-known electroplating method is preferably used. In addition, it is possible to control the coating weight of the coating layer by adjusting energization time, which is commonly done.

2-2) Base Steel Sheet

To obtain a hot-pressed member having a strength of 980 MPa or more, a hot-rolled steel sheet or a cold-rolled steel sheet having, for example, a chemical composition containing, by mass %, C:0.15% or more and 0.50% or less, Si: 0.05% or more and 2.00% or less, Mn: 0.5% or more and 3.0% or less, P: 0.10% or less, S: 0.05% or less, Al: 0.10% or less, N: 0.010% or less, and the balance being Fe and inevitable impurities may be used as a base steel sheet for the coating layer. The reasons for the limitations on the constituent chemical elements will be described hereafter.

"%" used when describing a chemical composition always represents "mass %", unless otherwise noted.

C: 0.15% or More and 0.50% or Less

C increases the strength of steel, and it is necessary that the C content be 0.15% or more to control the TS of a hot-pressed member to be 980 MPa or more. On the other hand, when the C content is more than 0.50%, there is a significant decrease in the blanking workability of a steel sheet as a raw material. Therefore, the C content is 0.15% or more and 0.50% or less.

Si: 0.05% or More and 2.00% or Less

Si, like C, increases the strength of steel, and it is necessary that the Si content be 0.05% or more to control the TS of a hot-pressed member to be 980 MPa or more. On the other hand, when the Si content is more than 2.00%, there is a significant increase in the occurrence of surface defects called red scale when hot rolling is performed, there is an increase in rolling load, and there is a decrease in the ductility of a hot-rolled steel sheet. Moreover, when the Si content is more than 2.00%, there may be a negative effect on coating performance when performing a coating treatment to form a coating film containing mainly Zn and Al on the surface of a steel sheet. Therefore, the Si content is 0.05% or more and 2.00% or less.

Mn: 0.5% or More and 3.0% or Less

Mn is effective to increase hardenability by inhibiting ferrite transformation and effective to lower the heating temperature before hot pressing is performed as a result of lowering the $Ac_3$ transformation point. To realize such effects, it is necessary that the Mn content be 0.5% or more. On the other hand, when the Mn content is more than 3.0%, there is a decrease in the uniformity of the properties of a steel sheet as a raw material and a hot-pressed member as a result of Mn being segregated. Therefore, the Mn content is 0.5% or more and 3.0% or less.

P: 0.10% or Less

When the P content is more than 0.10%, there is a decrease in uniformity of the properties of a steel sheet as a raw material and a hot-pressed member as a result of P being segregated, and there is a significant decrease in toughness. Therefore, the P content is 0.10% or less.

S: 0.05% or Less

When the S content is more than 0.05%, there is a decrease in the toughness of a hot-pressed member. Therefore, the S content is 0.05% or less.

Al: 0.10% or Less

When the Al content is more than 0.10%, there is a decrease in the blanking workability and hardenability of a steel sheet as a raw material. Therefore, the Al content is 0.10% or less.

N: 0.010% or Less

When the N content is more than 0.010%, since nitride (AlN) is formed when hot rolling is performed and when heating is performed before hot pressing is performed, there is a decrease in blanking workability and hardenability of a steel sheet as a raw material. Therefore, the N content is 0.010% or less.

The balance of the chemical composition includes Fe and inevitable impurities. Because of the reasons described below, it is preferable that at least one selected from Cr: 0.01% or more and 1.0% or less, Ti: 0.20% or less, and B: 0.0005% or more and 0.0800% or less be added separately from or along with Sb: 0.003% or more and 0.030% or less.

Cr: 0.01% or More and 1.0% or Less

Cr is effective to increase the strength of steel and increase hardenability. To realize such effects, it is preferable that the Cr content be 0.01% or more. On the other hand, when the Cr content is more than 1.0%, there is a significant increase in cost. Therefore, it is preferable that the upper limit of the Cr content be 1%.

Ti: 0.20% or Less

Ti is effective to increase the strength of steel and increase toughness as a result of decreasing grain diameter. In addition, Ti is also effective to achieve the effect of increasing hardenability through the use of solid solute B as a result of forming nitrides before B described below does. However, when the Ti content is more than 0.20%, there is a significant increase in rolling load when hot rolling is performed, and there is a decrease in the toughness of a hot-pressed member. Therefore, it is preferable that the upper limit of the Ti content be 0.20%.

B: 0.0005% or More and 0.0800% or Less

B is effective to increase hardenability when hot pressing is performed and to increase toughness after hot pressing has been performed. To realize such effects, it is preferable that the B content be 0.0005% or more. On the other hand, when the B content is more than 0.0800%, there is a significant increase in rolling load when hot rolling is performed and, for example, cracking occurs in a steel sheet due to formation of a martensite phase and a bainite phase after hot rolling has been performed. Therefore, it is preferable that the upper limit of the B content be 0.0800%.

Sb: 0.003% or More and 0.030% or Less

Sb is effective to inhibit a decarburized layer in the surface layer of a steel sheet from forming when the steel sheet is heated before hot pressing is performed until the steel sheet is cooled through the series of treatments in hot pressing. To realize such an effect, it is necessary that the Sb content be 0.003% or more. On the other hand, when the Sb content is more than 0.030%, there is a decrease in productivity due to an increase in rolling load. Therefore, it is preferable that the Sb content be 0.003% or more and 0.030% or less.

2-3) Heating and Hot Pressing

It is necessary that hot pressing be performed on the coated steel sheet described above after heating has been performed under the heating conditions satisfying expressions (1) and (2):

$$850 \leq T \leq 950 \quad (1)$$

$$0 < t \leq \{20-(T/50)+(W/10)\} \quad (2),$$

where T represents the peak temperature (° C.) of the coated steel sheet, t represents a total heating time (minutes) of the coated steel sheet from the start of the heating to the end of the heating, and W represents the coating weight per side ($g/m^2$).

As indicated by expression (1), the peak temperature of a coated steel sheet when heating is performed before hot pressing is performed is 850° C. or higher and 950° C. or lower. When the peak temperature is lower than 850° C., since the steel sheet is insufficiently quenched, desired hardness cannot be achieved. In addition, when the heating temperature is higher than 950° C., there is a decrease in economic efficiency in terms of energy. In addition, there is a decrease in paint adhesiveness due to an increase in void formation rate as a result of the excessive progress of oxide film formation.

Moreover, it is preferable that the peak temperature be equal to or higher than the $Ac_3$ transformation point. By controlling the peak temperature to be equal to or higher than the $Ac_3$ transformation point, since a steel sheet is sufficiently quenched, desired hardness can be achieved.

As indicated by expression (2), a total heating time of the coated steel sheet when heating is performed from the start of the heating to the end of the heating which is performed before hot pressing is performed is specified. The formation process of voids which cause a decrease in paint adhesiveness will be described. When heating of a coated steel sheet is continued, since the oxidation reaction of Zn, which is the component of the coating layer, progresses, the thickness of an oxide film containing Zn goes on increasing. Along with this, the diffusion reaction of Zn and Ni into the base steel sheet, which are the components of the coating layer, also progresses. Due to these reactions, voids are formed at the places where a coating layer originally existed. Therefore, the void formation rate increases with increasing peak temperature of a coated steel sheet and with increasing total heating time of a coated steel sheet. Moreover, the time taken to consume Zn through formation of the oxide film and diffusion into the base steel sheet decreases with decreasing coating weight before heating is performed, which results in the shorter time being taken to form voids. In addition, the time taken to form voids increases with increasing coating weight before heating is performed.

Expression (2) indicates such relationships in an integrated manner. That is, it indicates that the higher the peak temperature and the lower the coating weight, the shorter the total heating time needed to control the void formation rate to be 80% or less, is limited. On the other hand, it indicates that, the lower the peak temperature and the higher the coating weight, the longer the total heating time is accepted.

When a total heating time (t) is more than the value of $\{20-(T/50)+(W/10)\}$, since a void formation rate between the coating layer and the oxide film becomes more than 80%, paint adhesiveness becomes unsatisfactory.

Examples of a heating method before hot pressing is performed include heating using an electric furnace, gas furnace or the like, flame heating, electrical heating, high-frequency heating, induction heating, and far-infrared ray heating. Usually, heating before hot pressing is performed is started with charging a steel sheet having room temperature into any one of the heating apparatuses described above. The start of heating is defined as the time when the heating of a steel sheet having room temperature is started as described above. When a steel sheet having room temperature is first heated to a certain temperature, then held at the temperature, and then continuously heated to a higher temperature, the start of heating is defined as the time when the heating of a steel sheet having room temperature is started.

By setting the coated steel sheet which has been heated under the heating conditions described above on a mold having a die and a punch, by performing press forming, and then by performing cooling under desired cooling conditions, a hot-pressed member is manufactured.

EXAMPLE 1

A cold-rolled steel sheet having a chemical composition containing, by mass %, C: 0.23%, Si: 0.25%, Mn: 1.2%, P: 0.01%, S: 0.01%, Al: 0.03%, N: 0.005%, Cr, 0.2%, Ti: 0.02%, B: 0.0022%, Sb: 0.008%, and the balance being Fe and inevitable impurities, an $Ac_3$ transformation point of 820° C., and a thickness of 1.6 mm was used as a base steel sheet.

By coating the surface of the cold-rolled steel sheet with a Zn—Ni coating layer using an electroplating method, steel sheet Nos. 1 through 20 were manufactured. Zn—Ni coating layer was formed by performing a plating treatment in a plating bath containing 200 g/L of nickel sulfate hexahydrate and 10 to 100 g/L of zinc sulfate heptahydrate and having a pH of 1.5 and a bath temperature of 50° C. with a current density of 5 to 100 A/dm$^2$. By varying the addition quantity of zinc sulfate heptahydrate and a current density, Ni content was adjusted. In addition, by varying an energization time, coating weight was adjusted.

Heating was performed on the steel sheet Nos. 1 through 20 with the peak temperatures and the total heating times given in Table 1. Steel sheet No. 8 and steel sheet No. 9 were heated, respectively, using an electrical heating and a far-infrared ray heating, and all other steel sheets were heated using an electric furnace. Any of the steel sheets was rapidly cooled by inserting the steel sheet into a flat mold made of Al immediately after heating had been performed for the specified time.

Determination of a void formation rate and evaluation of paint adhesiveness were conducted on the obtained samples using the methods described below.

Void formation rate: a small piece of 10 mm×10 mm was cut out of a sample which had been heated and rapidly cooled, embedded in a resin, and then the cross section was observed using an EPMA as described above. Observation was performed in the field of view of an EPMA at a magnification of 500 times and, then, a void formation rate was defined as the digitized proportion of the length of the portions in which voids were formed to the total length of the coating layer.

Paint adhesiveness: a small piece of 70 mm×150 mm was cut out of the sample which had been heated and rapidly cooled and subjected to a chemical conversion treatment under the standard condition using PB-L3020 produced by Nihon Parkerizing CO., LTD., and then a test piece was prepared by performing electro-painting on the treated test piece so that the electrodeposition film thickness was 20 μm using GT-10 produced by Kansai Paint Co., Ltd. Then, a grid including 100 squares respectively having a side length of 1 mm was formed in the center of the test piece using a cutter knife so that the depth of the grid line reached the base steel sheet and, then, a grid tape peeling test was conducted in which cellophane tape was used to stick to and peel from the test piece. On the basis of the criteria below, paint adhesiveness was evaluated.

O: proportion of an area with a paint film left=100%

X: proportion of an area with a paint film left≤99%

The details of the coating layers, the determination results of void formation rates, and the evaluation results of paint adhesiveness of steel sheet Nos. 1 through 20 are given in Table 1.

TABLE 1

| Steel Sheet No. | Coating Layer: Ni Content (mass %) | Coating Layer: Coating Weight (g/m2) | Heating Condition: T: Peak Temperature (° C.) | Heating Condition: t: Total Heating Time (minute) | 20 − (T/50) + (W/10) | Void Formation Rate (%) | Paint Adhesiveness | Note | Remark |
|---|---|---|---|---|---|---|---|---|---|
| 1 | 12 | 50 | 900 | 3 | 7 | 0 | ○ | Invention Example | |
| 2 | 10 | 50 | 900 | 3 | 7 | 0 | ○ | Invention Example | |
| 3 | 25 | 50 | 900 | 3 | 7 | 0 | ○ | Invention Example | |
| 4 | 12 | 10 | 900 | 3 | 3 | 50 | ○ | Invention Example | |
| 5 | 12 | 90 | 900 | 3 | 11 | 0 | ○ | Invention Example | |
| 6 | 12 | 50 | 850 | 3 | 8 | 0 | ○ | Invention Example | |
| 7 | 12 | 50 | 950 | 3 | 6 | 0 | ○ | Invention Example | |
| 8 | 12 | 50 | 900 | 0.1 | 7 | 0 | ○ | Comparative Example | Electrical Heating |
| 9 | 12 | 50 | 900 | 1.5 | 7 | 0 | ○ | Comparative Example | Far-infrared Ray Heating |
| 10 | 12 | 50 | 900 | 5 | 7 | 15 | ○ | Invention Example | |
| 11 | 12 | 50 | 900 | 7 | 7 | 60 | ○ | Invention Example | |
| 12 | 8 | 50 | 900 | 3 | 7 | 90 | X | Comparative Example | |
| 13 | 12 | 5 | 900 | 3 | 2.5 | 100 | X | Comparative Example | |
| 14 | 12 | 5 | 800 | 5 | 4.5 | 85 | X | Comparative Example | Insufficient Strength |
| 15 | 12 | 50 | 1000 | 3 | 5 | 85 | X | Comparative Example | |
| 16 | 12 | 50 | 850 | 9 | 8 | 90 | X | Comparative Example | |
| 17 | 12 | 50 | 900 | 8 | 7 | 95 | X | Comparative Example | |
| 18 | 12 | 50 | 950 | 7 | 6 | 100 | X | Comparative Example | |
| 19 | 12 | 10 | 900 | 4 | 3 | 100 | X | Comparative Example | |
| 20 | 12 | 90 | 900 | 12 | 11 | 90 | X | Comparative Example | |

Steel sheet Nos. 1 through 11 manufactured using our manufacturing method had a void formation rate of 80% or less and excellent paint adhesiveness. In addition, steel sheet Nos. 1 through 11 manufactured using our manufacturing method and comparative example steel sheet Nos. 12, 13, and 15 through 20 had a strength of 980 MPa or more. However, steel sheet No. 14, whose peak temperature was 800° C., had an insufficient strength of less than 980 MPa.

EXAMPLE 2

Cold-rolled steel sheets having the chemical compositions containing constituent chemical elements given in Table 2 and the balance being Fe and inevitable impurities, the $Ac_3$ transformation points given in Table 2, and a thickness of 1.6 mm were used as base steel sheets. By coating both surfaces of the cold-rolled steel sheets with Zn—Ni coating layers as done in EXAMPLE 1, steel sheets Nos. 21 through 35 having the Ni contents and the coating weights given in Table 3 were manufactured.

Steel sheets Nos. 21 through 35, which had been manufactured as described above, were heated with the peak temperatures and total heating times given in Table 3 using an electric furnace, and then rapidly cooled by inserting the steel sheets into a flat mold made of Al immediately after heating had been performed for the specified heating times.

Determination of a void formation rate and evaluation of paint adhesiveness were conducted on the obtained samples as done in EXAMPLE 1.

The details of the coating layers, the determination results of void formation rates, and the evaluation results of paint adhesiveness of steel sheet Nos. 21 through 35 are given in Table 3.

TABLE 2

| Steel Grade | Chemical Composition of Steel Sheet (mass %): C | Si | Mn | P | S | Al | N | Cr | Ti | B | Sb | $Ac_3$ Transformation Point (° C.) |
|---|---|---|---|---|---|---|---|---|---|---|---|---|
| A | 0.24 | 0.25 | 1.3 | 0.02 | 0.005 | 0.02 | 0.003 | — | — | — | — | 805 |
| B | 0.18 | 0.25 | 1.3 | 0.02 | 0.005 | 0.02 | 0.003 | 0.15 | — | — | — | 816 |
| C | 0.42 | 0.25 | 1.3 | 0.02 | 0.005 | 0.02 | 0.003 | — | 0.03 | — | — | 785 |
| D | 0.24 | 0.10 | 1.3 | 0.02 | 0.005 | 0.02 | 0.003 | — | — | 0.0025 | — | 798 |
| E | 0.24 | 1.65 | 1.3 | 0.02 | 0.005 | 0.02 | 0.003 | 0.02 | 0.03 | — | — | 879 |
| F | 0.24 | 0.25 | 0.6 | 0.02 | 0.005 | 0.02 | 0.003 | 0.80 | — | 0.0025 | — | 817 |
| G | 0.24 | 0.25 | 2.5 | 0.02 | 0.005 | 0.02 | 0.003 | — | 0.16 | 0.0025 | — | 833 |
| H | 0.24 | 0.25 | 1.3 | 0.08 | 0.005 | 0.02 | 0.003 | 0.15 | 0.03 | 0.0010 | — | 857 |
| I | 0.24 | 0.25 | 1.3 | 0.02 | 0.04 | 0.02 | 0.003 | — | — | — | 0.008 | 805 |
| J | 0.24 | 0.25 | 1.3 | 0.02 | 0.005 | 0.08 | 0.003 | 0.15 | — | — | 0.008 | 827 |
| K | 0.24 | 0.25 | 1.3 | 0.02 | 0.005 | 0.02 | 0.009 | — | 0.03 | — | 0.008 | 817 |
| L | 0.24 | 0.25 | 1.3 | 0.02 | 0.005 | 0.02 | 0.003 | — | — | 0.07 | 0.008 | 805 |
| M | 0.24 | 0.25 | 1.3 | 0.02 | 0.005 | 0.02 | 0.003 | 0.15 | 0.03 | — | 0.004 | 815 |
| N | 0.24 | 0.25 | 1.3 | 0.02 | 0.005 | 0.02 | 0.003 | 0.15 | — | 0.0025 | 0.025 | 803 |
| O | 0.24 | 0.25 | 1.3 | 0.02 | 0.005 | 0.02 | 0.003 | — | 0.03 | 0.0025 | 0.008 | 817 |

TABLE 3

| Steel Sheet No. | Steel Grade | Coating Layer: Ni Content (mass %) | Coating Layer: Coating Weight (g/m$^2$) | Heating Condition: T: Peak Temperature (° C.) | Heating Condition: t: Total Heating Time (minute) | 20 − (T/50) + (W/10) | Void Formation Rate (%) | Paint Adhesiveness | Note |
|---|---|---|---|---|---|---|---|---|---|
| 21 | A | 12 | 50 | 900 | 3 | 7 | 0 | ○ | Invention Example |
| 22 | B | 12 | 50 | 900 | 3 | 7 | 0 | ○ | Invention Example |
| 23 | C | 12 | 50 | 900 | 3 | 7 | 0 | ○ | Invention Example |
| 24 | D | 12 | 50 | 900 | 3 | 7 | 0 | ○ | Invention Example |
| 25 | E | 12 | 50 | 900 | 3 | 7 | 0 | ○ | Invention Example |
| 26 | F | 12 | 50 | 900 | 3 | 7 | 0 | ○ | Invention Example |
| 27 | G | 12 | 50 | 900 | 3 | 7 | 0 | ○ | Invention Example |
| 28 | H | 12 | 50 | 900 | 3 | 7 | 0 | ○ | Invention Example |
| 29 | I | 12 | 50 | 900 | 3 | 7 | 0 | ○ | Invention Example |
| 30 | J | 12 | 50 | 900 | 3 | 7 | 0 | ○ | Invention Example |
| 31 | K | 12 | 50 | 900 | 3 | 7 | 0 | ○ | Invention Example |
| 32 | L | 12 | 50 | 900 | 3 | 7 | 0 | ○ | Invention Example |
| 33 | M | 12 | 50 | 900 | 3 | 7 | 0 | ○ | Invention Example |
| 34 | N | 12 | 50 | 900 | 3 | 7 | 0 | ○ | Invention Example |
| 35 | O | 12 | 50 | 900 | 3 | 7 | 0 | ○ | Invention Example |

Steel sheet Nos. 21 through 35 manufactured using our manufacturing method had a void formation rate of 80% or less and excellent paint adhesiveness. In addition, steel sheet Nos. 21 through 35 manufactured using our manufacturing method had a strength of 980 MPa or more.

The invention claimed is:

1. A hot-pressed member comprising a continuous coating layer containing Zn and Ni on a surface of a steel sheet of which the hot-pressed member is formed, and a continuous oxide film containing Zn on the coating layer, wherein a void formation rate is 80% or less for voids formed between the coating layer and the oxide film.

2. A hot-pressed member according to claim 1 is produced by coating a steel sheet and heating a coated steel sheet with a heating condition of a heating temperature 850 to 950° C. and a total heating time 3 to 7 (min.).

3. A method of manufacturing a hot-pressed member comprising:

heating a coated steel sheet having a coating layer on a surface of the steel sheet, which contains 10 mass% or more and 25 mass% or less of Ni and the balance being Zn and inevitable impurities and which has a coating weight per side of 10 g/m$^2$ or more and 90 g/m$^2$ or less, under heating conditions satisfying expressions (1) and (2):

$$850 \leq T \leq 950 \quad (1)$$

$$0 < t \leq \{20-(T/50)+(W/10)\} \quad (2),$$

where T represents a peak temperature (° C.) of the coated steel sheet, t represents a total heating time (minutes) of the coated steel sheet from a start of the heating to an end of the heating, and W represents coating weight per side (g/m$^2$), and then performing hot pressing on the heated steel sheet.

4. The method of manufacturing the hot-pressed member according to claim 3, wherein the heating condition further satisfies an expression (3)

$$3 \leq t \leq 7 \quad (3).$$

* * * * *